US010269520B2

(12) United States Patent
Honick et al.

(10) Patent No.: US 10,269,520 B2
(45) Date of Patent: Apr. 23, 2019

(54) PERMANENT MAGNET CONTACTOR

(71) Applicant: Ford Global Technologies, LLC, Dearborn, MI (US)

(72) Inventors: Charles Honick, Livonia, MI (US); Dylan Erb, Allen Park, MI (US); John Sturza, Royal Oak, MI (US); Abdul Lateef, Canton, MI (US); Philip Michael Gonzales, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 69 days.

(21) Appl. No.: 15/673,523

(22) Filed: Aug. 10, 2017

(65) Prior Publication Data

US 2019/0051481 A1 Feb. 14, 2019

(51) Int. Cl.

| | |
|---|---|
| ***H01H 50/16*** | (2006.01) |
| ***H01H 50/54*** | (2006.01) |
| ***H01H 50/14*** | (2006.01) |

(52) U.S. Cl.

CPC ..... *H01H 50/541* (2013.01); *H01H 50/14* (2013.01); *H01H 50/16* (2013.01); *H01H 2205/002* (2013.01); *H01H 2235/01* (2013.01)

(58) Field of Classification Search

CPC ..... H01H 50/541; H01H 50/14; H01H 50/16; H01H 2205/002; H01H 2235/01

See application file for complete search history.

(56) References Cited

U.S. PATENT DOCUMENTS

| | | | | |
|---|---|---|---|---|
| 3,051,805 | A * | 8/1962 | Binford | G01F 1/28 200/840 |
| 5,321,377 | A * | 6/1994 | Aharonian | H01H 50/16 335/128 |
| 8,736,406 | B2 * | 5/2014 | Hapke | D06F 37/42 335/207 |
| 9,082,576 | B2 | 7/2015 | Nishimura | |
| 9,117,605 | B2 | 8/2015 | An et al. | |
| 9,281,148 | B2 | 3/2016 | Enomoto | |

* cited by examiner

*Primary Examiner* — Mohamad A Musleh

(74) *Attorney, Agent, or Firm* — David Kelley; Brooks Kushman, P.C.

(57) ABSTRACT

A power system is disclosed. The system may include an electrical contactor including a pair of plates arranged to scissor between open and closed positions. The plates may have magnets embedded therein such that in the closed position, a subset of the magnets having opposite polarity are aligned to encourage touching of electrical contacts of the plates, and in the open position, a subset of the magnets having same polarity are aligned to encourage separation of the electrical contacts.

19 Claims, 3 Drawing Sheets

PERMANENT MAGNET CONTACTOR

TECHNICAL FIELD

The present disclosure pertains to electro-mechanical switches.

BACKGROUND

A hybrid or an electric vehicle may be equipped with at least one traction battery connected to an electrical load and configured to provide energy for propulsion. The traction battery may also provide energy, e.g., by an electrical bus, for other electrical systems. For example, the traction battery may transfer energy to high voltage loads, such as compressors and electric heaters. An electrical contactor may be a switch electrically connected between the battery and the electrical load and configured to open to disconnect the battery from the load and close to connect the battery to the load.

SUMMARY

According to one embodiment of this disclosure, a power system is disclosed. The system may include an electrical contactor including a pair of plates arranged to scissor between open and closed positions. The plates may have magnets embedded therein such that in the closed position, a subset of the magnets having opposite polarity are aligned to encourage touching of electrical contacts of the plates, and in the open position, a subset of the magnets having same polarity are aligned to encourage separation of the electrical contacts.

According to another embodiment of this disclosure, an electrical contactor is provided. The electrical contactor may include a pair of plates that may be arranged to scissor between open and closed positions, the plates may include magnets and electrical contacts embedded therein, such that responsive to a subset of the magnets of same polarity being brought into alignment, the plates repel to separate the electrical contacts, and responsive to a subset of the magnets of opposite polarity being brought into alignment, the plates attract to connect the electrical contacts.

According to yet another embodiment of this disclosure, a method of operating an electrical contactor is provided. The method may include opening the electrical contactor by, moving a rotating a plate, pivotally connected to a fixed plate by a pin defining an axis, in a first direction transverse to the axis and displacing the rotating plate in a second direction, along the axis, by a magnetic force exerted between a first magnet disposed within the rotating plate and a second magnet disposed within the fixed plate.

DETAILED DESCRIPTION

Various embodiments of the present disclosure are described herein. However, the disclosed embodiments are merely exemplary and other embodiments may take various and alternative forms that are not explicitly illustrated or described. The figures are not necessarily to scale; some features may be exaggerated or minimized to show details of particular components. Therefore, specific structural and functional details disclosed herein are not to be interpreted as limiting, but merely as a representative basis for teaching one of ordinary skill in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. However, various combinations and modifications of the features consistent with the teachings of this disclosure may be desired for particular applications or implementations.

Generally, the contacts close and open by powering a low-voltage electric circuit to actuate a solenoid to move the contacts in an axial direction. At times, the contacts may stick together due to a weld forming between the contacts. Higher than normal currents, a loose rivet joint, a poor weld or brazed joint may contribute to contact heating which may lead to welding. Actuating the solenoid in an axial direction to maintain the electrical connection between the contacts may require more energy than an electrical contactor arranged in a different manner as will be described in greater detail below. Moreover, an axially actuated contactor may open and close inadvertently and rapidly, causing a condition frequently referred to as "chatter." Chatter may be due to a loose connection, or two or more switches that contact one another due their close proximity and vibrations, or both. Chatter may lead to an inconsistent electrical connection or cause a noise that may be a customer annoyance. It may be advantageous to maintain the contactor in an open position, as a default position, and actuate the contactor in along a transverse direction, as opposed to an axial direction to prevent the contactor from inadvertently closing.

A contactor is an electrically controlled switch used for switching an electrical power circuit. A contactor is similar to a relay but is capable of managing higher currents. A contactor is typically controlled by a circuit which has a much lower power level than the switched circuit, such as a 24-volt coil electromagnet controlling 220-volt motor switch. The following disclosure may pertain to contactors used to control electric motors, lighting, heating applications, capacitor banks, thermal evaporators, and other electrical loads.

Figure 1:
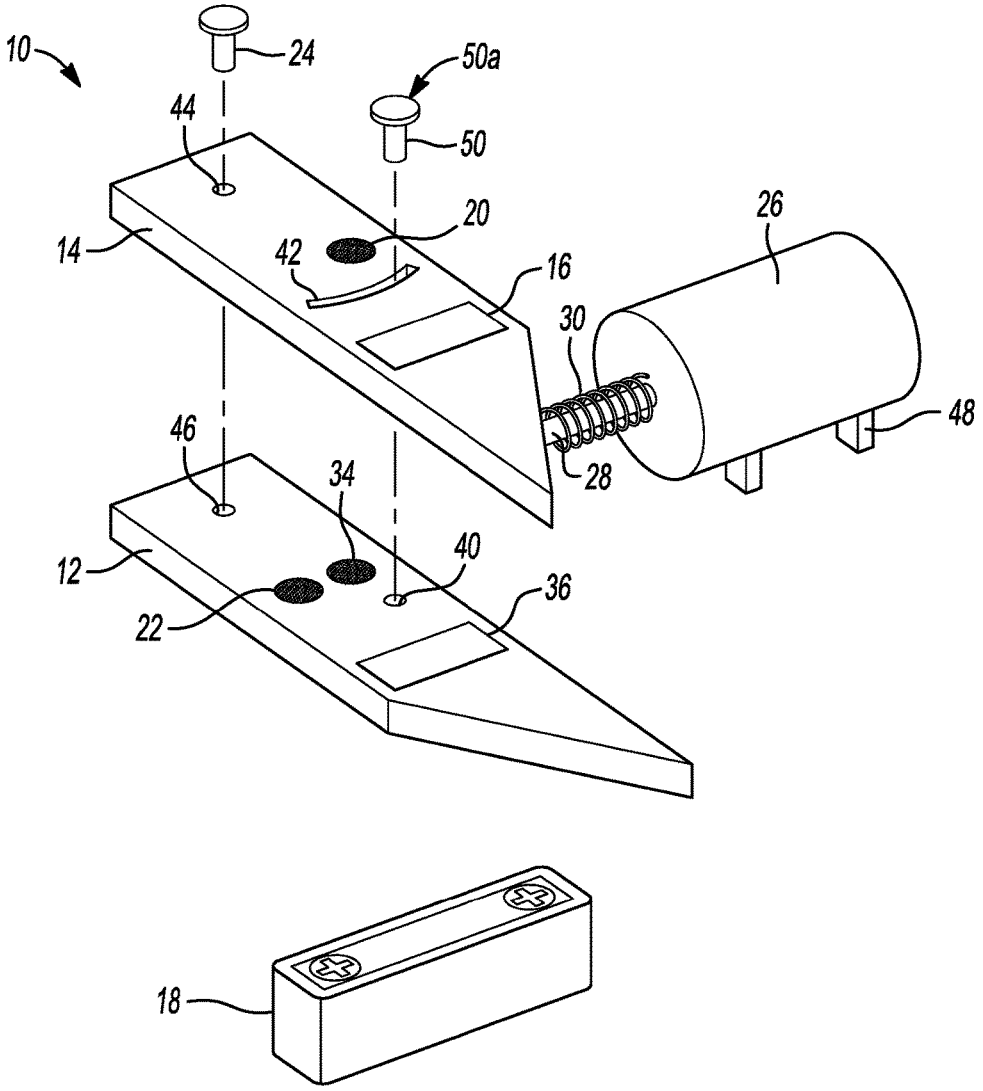
FIG. 1 is an exploded view of an electrical contactor.
Figure 2A:
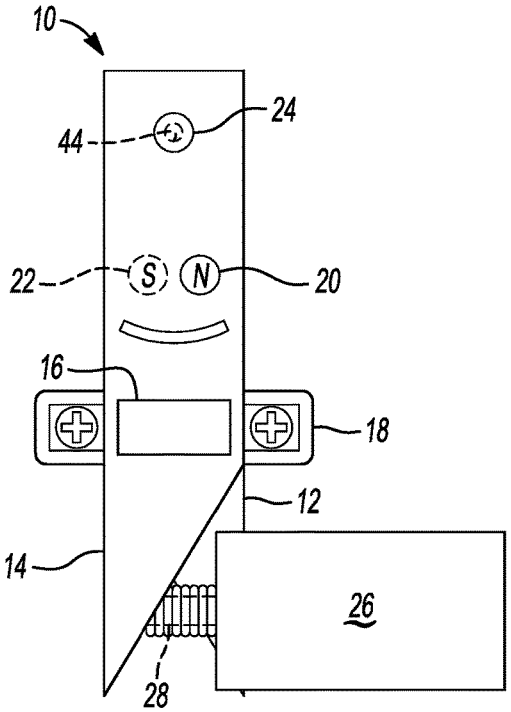
FIG. 2A is a top view of an electrical contactor in the closed position.

Referring to FIG. 1, an exploded view of an electrical contactor assembly 10 is illustrated. The electrical contactor 10 includes a stationary plate 12 that is pivotally connected to a rotating plate 14 at a pivot point 44. The stationary plate may be referred to as a bottom plate, a fixed plate, or a non-rotating plate. The stationary plate 12 and the rotating plate 14 may be attached to one another by a bushing, or rivet, fastener, weld stud, bolt, or other suitable fastening members 24. The stationary plate 12 includes a stationary contact 36 and the rotating plate 14 includes a rotating contact 16. When the rotating plate 14 and the rotating contact are adjacent to stationary contact 36 and the stationary plate 12, as shown in FIG. 2A, electric energy flows between a traction battery (not shown) and a main load (not shown). The stationary plate 12 is connected to a voltage terminal 18 that may be connected to the traction battery or another power source. The voltage terminal 18 may be a high-voltage terminal or a low-voltage terminal or other suitable terminal used to transfer electric energy. The stationary plate 12 and the rotating plate 14 may be comprised of rigid plastic including but not limited to thermoplastic, thermoset plastics, or polymeric material. The stationary plate 12 and the rotating plate 14 may be manufactured by an injection molding or casting process.

That electrical contactor assembly 10 includes at least three magnets: a first magnet 20, a second magnet 22, and a third magnet 34. Two of the magnets 22 and 34 have a magnetic polarity that is opposite. For example, the second magnet 22 may have a north pole and the third magnet 34 may have a south pole, or vice-versa. While the second magnet 22 and third magnet 34 are shown within the stationary plate 12, they may also be disposed within the rotating plate. The first magnet 20 has a polarity that is opposite to that of the third magnet 34. Therefore, the first magnet 20 and the third magnet 34 are attracted to one another. The first magnet 20 has a polarity that is the same as the polarity of the second magnet 22 so that they are repelled from one another when they are placed within proximity of one another. The magnets are permanent magnets, made from a material that is magnetized and creates its own persistent magnetic field. The magnets may be made from a ferromagnetic material including but not limited to iron, nickel, cobalt, or alloys thereof. Some compounds of rare earth metals such as lanthanide, scandium, and yttrium may also be utilized.

Figure 2B:
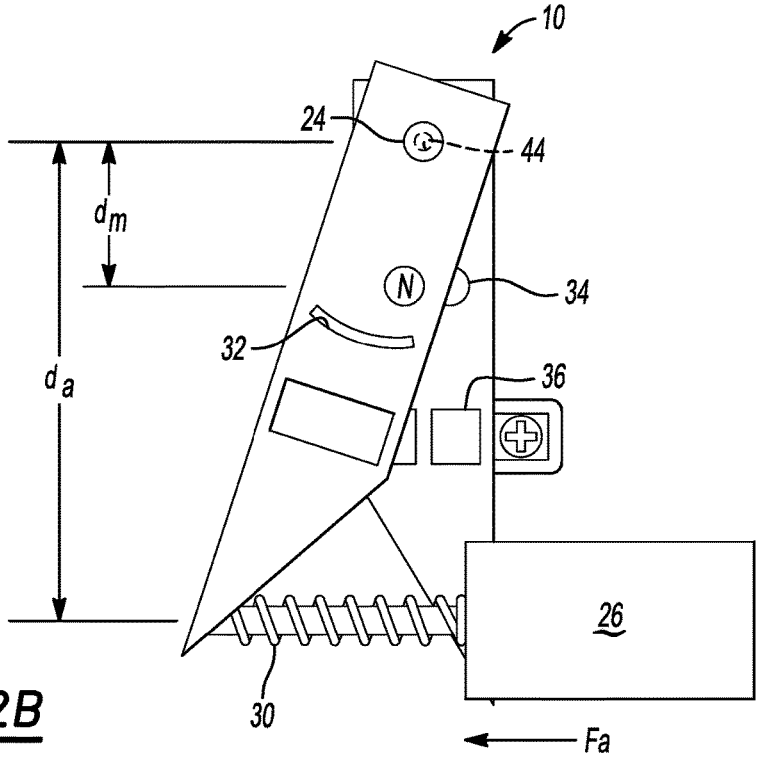
FIG. 2B is a top view of an electrical contactor in the open position.

A return spring 30 and a solenoid arm 28 extend between the rotating plate 14 and a solenoid or electromechanical actuator 26. The spring 30 may bias the solenoid arm 28 so that the rotating plate 14 is in the open position (FIG. 2B). The solenoid 26 may be actuated to retract the solenoid arm 28 and spring 30 so that the rotating plate 14 is in the closed position (FIG. 2A). The solenoid may receive electrical current through a low voltage terminal 48 or other suitable electrical connection device. The electromechanical actuator 26 may also be referred to as a solenoid, as previously mentioned, or an electric motor or other electric or electromechanical actuation device.

The rotating plate 14 may include a travel limit slot 42 that is spaced away from the pivot point 44. A travel limiter bolt or member 50 extends through the travel limit slot 42 from a travel limit aperture 40 defined by the stationary plate 12. As the contactor 10 is actuated from the closed position to the open position, the travel limiter member may move in the x-direction, from the right side of the slot 42 to the left side of the slot 42 so that the rotating plate 14 is not over extended. Moreover, the travel limiter 50 may include a head portion 50*a* that defines a diameter that is greater than a width of the slot 42.

As the rotating plate 14 and rotating magnet 20 moves in the x-direction so that the rotating magnet 20 is near the second magnet 22, the first magnet and second magnet are biased away from one another in the z-direction. The head portion 50*a* may come into contact with the top and bottom surface of the stationary plate 12 and rotating plate 12 so that the rotating and stationary plate are not overly spaced apart in the z-direction. While over travel of the rotating plate is prevented by the travel limiter member 50 extending from the aperture 40 through the slot 42, in other configurations the solenoid may include a travel stop or travel limiter to prevent the solenoid arm 28 from over extending.

The stationary plate 12 and the rotating plate 14, as shown, have a rectangular shape and a tapered end connected to a solenoid shaft 28. Note that the stationary plate 12 and the rotating plate 14 may have other shapes, including square, rectangular, and circular among others. Moreover, the solenoid arm 28 may be connected to another portion of the rotating plate 14, not just the distal end as illustrated in FIGS. 2A and 2B.

Referring to FIGS. 2A and 2B, top views of the contactor assembly 10 in the closed position and the open position, respectively, are illustrated. Referring specifically to FIG. 2A, the solenoid 26 has moved the solenoid arm 28 to the retracted position and the spring 30 is compressed. When the solenoid arm 28 is retracted, the rotating plate 14 overlaps the stationary plate 12 so that the rotating contact 16 and non-rotating contact 36 transfer electricity to one another. Each of the contacts 16 and 36 may be sized according to the current requirements of the system. In the closed position, the rotating magnet 20 is attracted to the stationary third magnet 34.

Referring specifically to FIG. 2B, the solenoid 26 has moved the solenoid arm 28 to an extended position so that the rotating plate 14 is moved away from the stationary plate 12. In the open position, the rotating contact 16 and the non-rotating contact 36 are not in electrical communication with one another. The pivot point 44 and a center of the magnets 20, 22, and 34 are spaced apart by a distance $d_m$. The pivot point 44 is spaced apart from the actuator or solenoid arm 28 by a distance $d_a$. The force (Fa) required to open or close the contactor can be calculated by factoring the magnetic force (N) between the permanent magnets 34 and 20 as well as the coefficient of friction (μ) between the stationary plate 12 and the rotating plate 14. The following equation may be used to determine the force Fa:

$$Fa = \frac{\mu N dm}{da}$$

Figure 3A:
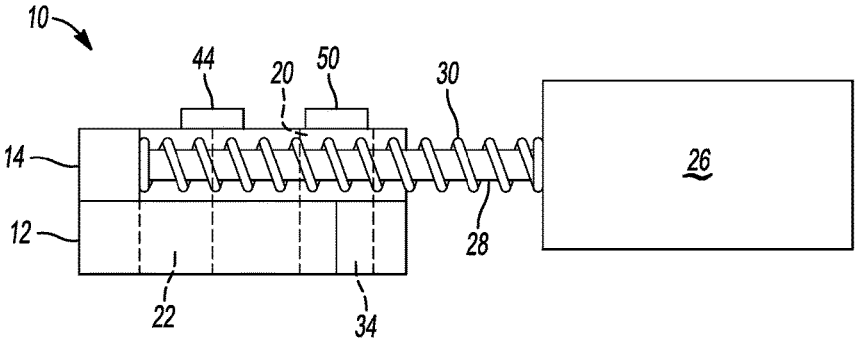
FIG. 3A is a plan view of an electrical contactor in the closed position.
Figure 3B:
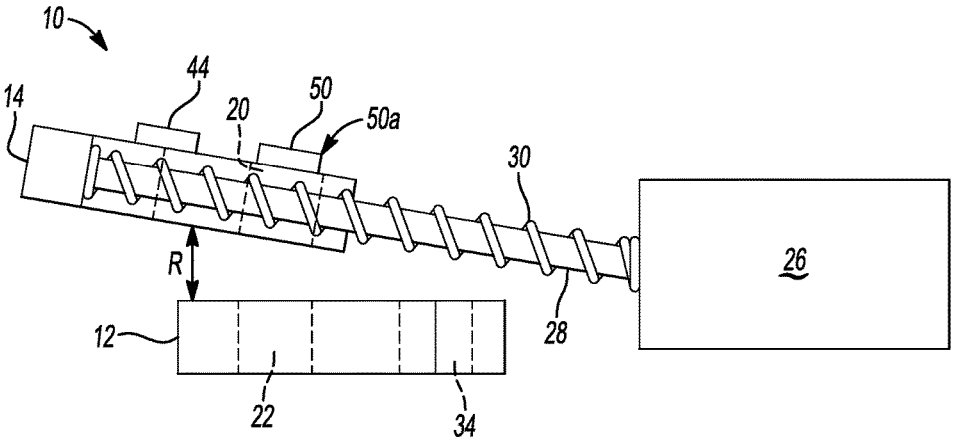
FIG. 3B is a plan view of an electrical contactor in the open position.

Referring to FIGS. 3A and 3B, plan views of the electrical contactor in the closed and open positions, respectively, are illustrated. As was previously mentioned, when in the closed position, the rotatable plate 14 of the electrical contactor overlaps the stationary plate 12. In this position, the solenoid arm 28 is retracted and the spring 30 is compressed. Moreover, the first magnet 20 is positioned over the attractive stationary magnet 34.

Referring specifically to FIG. 3B, the electrical contactor 10 is in the open or disconnected position. In the open position, the rotatable plate 14 is biased about the pivot point 44 (FIG. 2B) across the stationary plate 12 by the spring 30. In this configuration, the spring 30 biases the rotatable plate 14, towards the left of the figure and away from the fixed or stationary plate 12, when no power is applied to the solenoid 26. The solenoid may retract the solenoid arm 28 to compresses the spring to move the rotatable plate 14 to the closed position (FIG. 3A). The force required for the solenoid 26 to move the rotating plate from the open to the closed positions would be the spring rate of the spring 30 and the force exerted by the magnetic repulsive force 'R' associated with magnet 20 and magnet 22.

In other configurations the solenoid arm 28 may position the rotatable plate 14 in the open position and the spring 30 may retract or pull the rotatable plate 14 in response to the solenoid arm being retracted. In the open position, the first magnet 20 in the rotatable plate 14 is positioned over the second magnet 22 so that a magnetic repulsive force, indicated by the double-ended arrow 'R,' spaces the rotatable plate 14 away from the stationary plate 12 in the z-direction. The head 50*a* of the fastener or travel limiter 50 acts as a stop for the rotatable plate 14 in the z-direction.

The words used in the specification are words of description rather than limitation, and it is understood that various changes may be made without departing from the spirit and scope of the disclosure and claims. As previously described, the features of various embodiments may be combined to form further embodiments that may not be explicitly described or illustrated. While various embodiments may have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. A power system comprising:

an electrical contactor including a pair of plates arranged to scissor between open and closed positions, the plates having magnets embedded therein such that in the closed position, a subset of the magnets having opposite polarity are aligned to encourage touching of electrical contacts of the plates, and in the open position, a subset of the magnets having same polarity are aligned to encourage separation of the electrical contacts.

2. The power system of claim 1, wherein the pair includes a fixed plate and a rotating plate, and wherein when in the closed position, at least a portion of the rotating plate overlaps and touches at least a portion of the fixed plate, and when in the open position, the rotating plate is spaced away from the fixed plate.

3. The power system of claim 2, wherein the electrical contactor further includes a spring connected to the rotating plate, and configured to bias the rotating plate to either the open position or the closed position.

4. The power system of claim 2 wherein the electrical contactor further includes an electromechanical actuator connected to the rotating plate, and configured to move the rotating plate from either the closed position to the open position and vice-versa.

5. The power system of claim 2 wherein the electrical contactor further includes a high-voltage terminal electrically connected to the fixed plate, and configured to electrically connect a battery to the electrical contactor.

6. The power system of claim 2 wherein the electrical contactor further includes a travel limit member extending from the fixed plate through an elongated slot defined by the rotating plate, and configured to stop the rotating plate as the rotating plate is moved from the open position to the closed position and vice-versa.

7. The power system of claim 2 wherein the electrical contactor further includes a bushing including a head attached to a shaft defining an axis, and pivotally connecting the rotating plate to the fixed plate, wherein the head acts as a stop as the rotating plate moves along the axis defined by the bushing.

8. An electrical contactor comprising:

a pair of plates arranged to scissor between open and closed positions, the plates having magnets and electrical contacts embedded therein such that responsive to a subset of the magnets of same polarity being brought into alignment, the plates repel to separate the electrical contacts, and responsive to a subset of the magnets of opposite polarity being brought into alignment, the plates attract to connect the electrical contacts.

9. The electrical contactor of claim 8, wherein the pair includes a fixed plate and a rotating plate, and wherein when the rotating plate moves between the open and closed positions, the rotating plate moves along a curved trajectory relative to the fixed plate.

10. The electrical contactor of claim 9, wherein the magnets include first, second, and third magnets, and wherein the first magnet is disposed within the rotating plate and the second and third magnets are disposed within the fixed plate and have opposite polarity.

11. The electrical contactor of claim 10 further comprising a travel limit post extending from the fixed plate through an elongated slot defined by the rotating plate, and configured to stop the rotating plate as the rotating plate moves from the open position to the closed position and vice-versa.

12. The electrical contactor of claim 10, wherein the first, second, and third magnets are spaced away from a pin by a first distance, and wherein an elongated slot defined by the rotating plate is spaced away from the pin by a second distance greater than the first.

13. The electrical contactor of claim 10 further comprising an electromechanical actuator configured to move the rotating plate between the open and closed positions.

14. The electrical contactor of claim 10 further comprising a spring connected to the rotating plate, and configured to bias the rotating plate toward either the open position or the closed position.

15. The electrical contactor of claim 10 further comprising a high-voltage terminal electrically connected to the fixed plate, and configured to electrically connect a battery to the electrical contactor.

16. A method of operating an electrical contactor comprising:

opening the electrical contactor by, moving a rotating plate, pivotally connected to a fixed plate by a pin defining an axis, in a first direction transverse to the axis; and displacing the rotating plate in a second direction, along the axis, by a magnetic force exerted between a first magnet disposed within the rotating plate and a second magnet disposed within the fixed plate.

17. The method of claim 16, wherein the moving is performed by powering a solenoid to displace a shaft connected to the rotating plate.

18. The method of claim 17 further comprising closing the electrical contactor by, retracting the shaft to move the rotational plate in a third direction, opposite to the first; and displacing the rotating plate in a fourth direction, opposite to the second direction, responsive to the first magnet being aligned with a third magnet disposed within the fixed plate.

19. The method of claim 18, wherein the retracting is performed by biasing a return spring connected to the fixed plate and the rotating plate.

* * * * *